US009578416B2

(12) United States Patent
Gautama

(10) Patent No.: US 9,578,416 B2
(45) Date of Patent: Feb. 21, 2017

(54) CONTROL OF A LOUDSPEAKER OUTPUT

(75) Inventor: Temujin Gautama, Boutersem (BE)

(73) Assignee: NXP B.V., Eindhoven (NL)

( * ) Notice: Subject to any disclaimer, the term of this patent is extended or adjusted under 35 U.S.C. 154(b) by 716 days.

(21) Appl. No.: 13/296,271

(22) Filed: Nov. 15, 2011

(65) Prior Publication Data

US 2012/0121098 A1 May 17, 2012

(30) Foreign Application Priority Data

Nov. 16, 2010 (EP) ..... 10191426
Jul. 12, 2011 (EP) ..... 11173638

(51) Int. Cl.
*H04R 29/00* (2006.01)
*H04R 3/00* (2006.01)

(52) U.S. Cl.
CPC ..... *H04R 3/007* (2013.01); *H04R 3/002* (2013.01); *H04R 29/003* (2013.01)

(58) Field of Classification Search
CPC ..... H04R 3/04; H04R 3/002; H04R 3/007; H04R 3/00; H04R 3/08; H04R 6/06; H04R 7/20; H04R 1/2834; H04R 1/2842; H04R 9/06; H04S 7/307
USPC ..... 381/55–56, 58–59, 96, 189
See application file for complete search history.

(56) References Cited

U.S. PATENT DOCUMENTS 5,577,126 A 11/1996 Klippel
6,940,981 B2 * 9/2005 Neunaber ..... H03F 1/52 330/254
7,372,966 B2 5/2008 Bright
8,577,047 B2 11/2013 Gautama
8,942,381 B2 * 1/2015 Gautama ..... H04R 29/003 381/55
9,042,561 B2 * 5/2015 Gautama ..... H04R 3/007 381/55
2003/0021427 A1 1/2003 Nakada et al.
2003/0072462 A1 4/2003 Hlibowicki
2005/0207584 A1 * 9/2005 Bright ..... 381/59
2007/0057720 A1 * 3/2007 Hand ..... H03F 1/523 330/10
2007/0140058 A1 * 6/2007 McIntosh et al. ..... 367/140
2009/0268918 A1 * 10/2009 Solgaard et al. ..... 381/55
2010/0046772 A1 2/2010 Veau et al.
(Continued)

FOREIGN PATENT DOCUMENTS

EP 1 799 013 A1 6/2007
WO 2006043219 A1 4/2006

OTHER PUBLICATIONS

Klippel, Wolfgang, "Distortion Analyzer—a New Tool for Assessing and Improving Electrodynamic Transducer", Convention Paper 5109 of the AES 111th Convention, Feb. 19, 2000, pp. 1-35.*
(Continued)

*Primary Examiner* — Xu Mei
(74) *Attorney, Agent, or Firm* — Rajeev Madnawat

(57) ABSTRACT

A control signal is generated for mechanical loudspeaker protection, or for other signal pre-processing functions. The procedure contains the following steps:

perform a non-linearity analysis based on current and voltage measurements;

use the results of the non-linearity analysis, and the voltage and current measurements to control audio processing for the loudspeaker thereby to implement loudspeaker protection and/or acoustic signal processing.

20 Claims, 2 Drawing Sheets

(56) References Cited

U.S. PATENT DOCUMENTS

| | | | | |
|---|---|---|---|---|
| 2012/0106750 | A1* | 5/2012 | Thormundsson ..... | H04R 3/007 381/71.12 |
| 2012/0288118 | A1 | 11/2012 | Gautama | |

OTHER PUBLICATIONS

Klippel, Wolfgang, "Active Compensation of Transducer Nonlinearities", AES 23rd Internation Conference, May 23, 2003, pp. 1-17.*

International standard "IEC 62458", Jan. 31, 2010 (Jan. 31, 2010), pp. 1-23, XP055065012, Geneva, Switzerland.*

Klippel, Wolfgang, "Distortion Analyzer—a New Tool for Assessing and Improving Electrodynamic Transducer", Convention Paper 5109 of the AES 11 lth Convention, Feb. 19, 2000, pp. 1-35.*

Klippel, Wolfgang, "Assessment of Voice Coil Peak Displacement Xmax", J. Audio Eng. Soc., vol. 51, No. 5, May 2003, p. 307-323.*

"AES Recommended Practice Specification of Loudspeaker Components Used in Professional Audio and Sound Reinforcement", Audio Eng. Soc. Inc. (1993), retrieved from Internet at http://diy-audio.narod.ru/litr/AES2-1984-r2003.pdf on Nov. 2011.

Klippel, W. "Assessment of Voice-Coil Peak Displacement $X_{max}$", J. Audio Eng. Soc., vol. 51, No. 5, pp. 307-323 (May 2003).

Klippel, W. et al. "Fast Measurement of Motor and Suspension Nonlinearities in Loudspeaker Manufacturing", J. Audio Eng. Soc., vol. 58, No. 3, pp. 115-125 (Mar. 2010).

Extended European Search Report for European Patent Application 10191426.5 (Mar. 15, 2011).

"Power Test (PWT) Software Module of the R&D System", Aug. 25, 2008 pp. 1-10, XP055065015.

* cited by examiner

CONTROL OF A LOUDSPEAKER OUTPUT

CROSS-REFERENCE TO RELATED APPLICATIONS

This application claims the priority under 35 U.S.C. §119 of European patent application no. 10191426.5, filed on Nov. 16, 2010, and 11173638.5, filed on Jul. 12, 2011, the contents of which are incorporated by reference herein.

This invention relates to the control of the output of a loudspeaker.

It is well known that the output of a loudspeaker should be controlled in such a way that it is not simply driven by an input signal. For example, an important cause of loudspeaker failures is a mechanical defect that arises when the loudspeaker diaphragm is displaced beyond a certain limit, which is usually supplied by the manufacturer. Going beyond this displacement limit either damages the loudspeaker immediately, or can considerably reduce its expected life-time.

There exist several methods to limit the displacement of the diaphragm of a loudspeaker, for example by processing the input signal with variable cut-off filters (high-pass or other), a gain stage, or a dynamic range compression module, the characteristics of which are controlled via a feedback loop. The measured control signal is referred to as the displacement predictor and it conveys information on how close the loudspeaker is driven to the displacement limit by the input signal. The control method requires modelling of the loudspeaker characteristics so that the displacement can be predicted in response to a given input signal. The model predicts the diaphragm displacement, also referred to as cone excursion, and it can be linear or non-linear.

A control system can be used for loudspeaker protection as mentioned above, or for linearisation of the loudspeaker output.

Loudspeaker protection is typically used when small signal distortions are allowed (e.g. for micro-speakers in mobile phones). Even though the loudspeakers can be driven into their non-linear behaviour region because signal distortion is acceptable, the loudspeaker should still be (mechanically) protected, for example by pre-processing the input signal in such a way that the loudspeaker diaphragm displacement stays below a limit value that is often supplied by the manufacturer.

Loudspeaker pre-compensation is used for linearisation of the loudspeaker output. The input signal is pre-processed ('pre-distorted') in such a way that the resulting loudspeaker diaphragm displacement matches that expected from the original input signal in the absence of loudspeaker non-linearities. This can increase the acoustical output of the loudspeaker that can be obtained without audible signal distortion (even though the distortions are physically generated).

Pre-compensation of a loudspeaker requires the estimation of a non-linear loudspeaker model, which can be computationally demanding.

The loudspeaker model (for pre-compensation or protection) generally requires the knowledge of at least one (fixed) mechanical parameter of the loudspeaker (most often the mechanical mass or the force factor), and of the (fixed) diaphragm displacement limit. The expected value of the displacement limit has to be either supplied by the loudspeaker manufacturer or it has to be measured. Thus, model parameters are typically determined on the basis of a signal registered by an additional sensor.

The actual value of the mechanical parameter can deviate from the expected value due to variations across samples, due to variations in the production process, and due to effects of loudspeaker aging.

There is therefore a need for a control signal to be used for the mechanical protection of a loudspeaker, which does not require knowledge of the mechanical parameters of the loudspeaker, nor of the displacement limit.

According to the invention, there is provided a method of controlling a loudspeaker output, comprising:

measuring a voltage and current signal;

performing a non-linearity analysis based on the voltage and current measurements; and using the results of the non-linearity analysis to control audio processing for the loudspeaker thereby to implement loudspeaker protection and/or acoustic signal processing.

The information derived from the nonlinearity analysis is used to derive a control scheme for the loudspeaker, without needing any manufacturer-supplied data, or any direct measurements of mechanical characteristics. Thus, the audio processing does not take into account the force factor of the loudspeaker or the moving mass of the loudspeaker.

In one example, the voltage and current signals are measured for a plurality of measurement frequencies which characterise a frequency-dependent impedance function of the loudspeaker, the voltage and current measurements are used to derive an arbitrarily scaled frequency dependent input voltage to excursion transfer function which is also used to control the audio processing; and wherein performing a non-linearity analysis comprises:

determining an input level at which the excursion reaches a maximum value; and determining the maximal displacement limit for the determined level based on the same arbitrary scaling, and wherein the result of the non-linearity analysis comprise the maximal displacement limit.

In this way, the arbitrarily scaled frequency-dependent input-voltage-to-excursion transfer function and a non-linear parameter are both derived from current and voltage measurements.

This example uses an arbitrarily scaled frequency-dependent input-voltage-to-excursion transfer function and a displacement limit that is scaled by the same arbitrary factor. This example of the invention is based on deriving a control signal by using a 'normalised' loudspeaker model (based on current and voltage measurements without additional mechanical information about the speaker) in combination with a 'normalised' displacement limit (based on a non-linearity analysis).

The audio processing can be performed in a loudspeaker protection module, or other loudspeaker drive system. Any protection module can be used.

The conceptual steps underlying the first example of the invention can be summarised as:

computing a 'normalised' loudspeaker model, which does not require mechanical parameters, that can be used for predicting the 'normalised' diaphragm displacement;

performing a non-linearity analysis, to determine the point where the actual (physical) diaphragm displacement reaches its maximally allowable value;

computing the 'normalised' excursion (from the normalised loudspeaker model) that corresponds to the signal for which the displacement limit is reached. This value can be considered to be a 'normalised' displacement limit, in that it is the excursion limit as referenced to the normalised loudspeaker model.

The control signal, which is to be used in combination with a loudspeaker drive module, can then be computed for a given input, on the basis of the normalised displacement limit and the normalised loudspeaker model. The normalised loudspeaker model can be made adaptive, e.g., by re-estimating its parameters after certain time intervals, or when requested by the system.

The loudspeaker model and displacement limit estimation can be implemented as part of a calibration procedure, such that the variability across samples due to the production procedure, or due to the effects of aging can be incorporated. The displacement limit estimation method requires the playback of specific test sequences.

The step of controlling a loudspeaker output can comprise using the voltage and current measurements to derive the frequency-dependent input-voltage-to-excursion transfer function, which is then used to control the audio processing.

The voltage and current measurements preferably characterise a frequency-dependent impedance function which does not take into account the mechanical properties of the loudspeaker. This means that no manufacturer data is needed, and indeed no information is needed other than the voltage and current measurements. In particular, the voltage and current measurements characterise a frequency-dependent impedance function which does not take into account the force factor of the loudspeaker or the moving mass of the loudspeaker. Furthermore, the voltage and current signals can be arbitrary scaled, since this does not affect the input-voltage-to-excursion transfer function. Controlling the audio processing can comprise deriving an attenuation value by which an input signal should be attenuated to provide loudspeaker protection.

The non-linearity level can comprise an input voltage signal which corresponds to a maximum allowable loudspeaker cone displacement. This can be derived purely electrically, for example using a harmonic distortion measurement, or it may be determined physically for example with optical detection of the displacement. The non-linearity represents the fact that as the cone displacement level is approached, the relationship between input voltage and cone displacement becomes increasingly non-linear. It is this fact that enables purely electrical analysis to be used to detect the non-linearity, if desired.

Even if optical detection (or other detection) is used for the cone displacement measurement, this still requires no manufacturer data about the mechanical speaker characteristics.

The first example of the invention essentially derives a loudspeaker model which can then be used within a conventional loudspeaker protection or linearity module.

Other examples make use of the non-linearity analysis to provide a more direct control scheme for providing the control of the loudspeaker output without requiring specific test sequences, and the non-linearity analysis can be performed during normal operation of the device. For example, controlling the audio processing can comprise processing the audio input to provide a limit to the parameter monitored in the non-linearity analysis. Thus, the non-linearity analysis is used as the control parameter for the feedback control system.

Controlling the audio processing can comprise processing the audio input to provide a limit to a parameter, which parameter is a direct or indirect cause of the non-linearity as monitored in the non-linearity analysis. Thus, the non-linearity analysis again provides the control input to the feedback control system, but the input signal is then adjusted to control a related parameter of the input signal.

The invention also provides a loudspeaker control system, comprising:

a loudspeaker;

a sensor for measuring a voltage and current signal; and a processor, wherein the processor is adapted to:

control the sensor to measure a voltage and current signal;

perform a non-linearity analysis based on the voltage and current measurements; and use the results of the non-linearity analysis to control audio processing for the loudspeaker thereby to implement loudspeaker protection and/or acoustic signal processing.

The method of the invention can be implemented in software.

An example of the invention will now be described in detail with reference to the accompanying drawings, in which.

Figure 1:
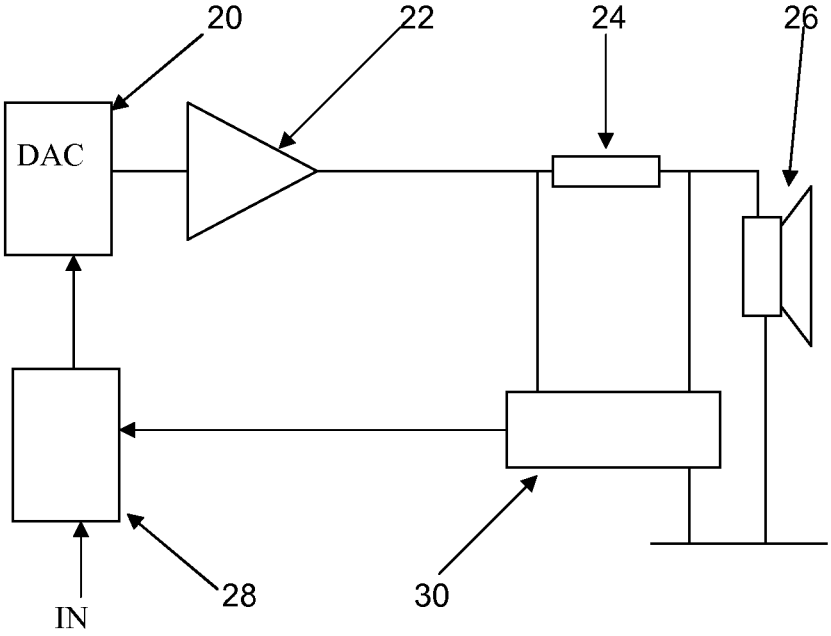
FIG. 1 shows a first example of loudspeaker control system of the invention.

The invention provides a method to generate a control signal that can be used for mechanical loudspeaker protection, or for other signal pre-processing functions. This control signal is for example a measure of how close the loudspeaker is driven to its mechanical displacement limit.

To compute the control signal, a procedure is performed, which contains the following conceptual steps:

perform a non-linearity analysis based on current and voltage measurements;

use the non-linearity analysis to enable a loudspeaker protection system to be implemented and in a way which does not require measurement of physical loudspeaker parameters.

A first implementation for the non-linear analysis is based on determining the point where the diaphragm displacement reaches its maximally allowable value and computing the normalised excursion (from the normalised loudspeaker model) that corresponds to the signal for which the displacement limit is reached.

In this case, when the normalised loudspeaker model and the normalised displacement limit are known, the control signal that is to be used in combination with a loudspeaker protection module can be computed for an arbitrary voltage signal.

The normalised loudspeaker model can be made adaptive, e.g., by re-estimating the model after certain time intervals. The model can be adapted independent of the normalised displacement limit (which can remain fixed).

The normalised displacement limit estimation requires a calibration procedure (at system start-up or as part of the manufacturing process).

The three basic steps of this first implementation of the method of the invention as outlined above will now be discussed in turn.

Normalised Loudspeaker Model

A traditional loudspeaker model can be used for predicting the diaphragm displacement of the voice coil (also referred to as cone excursion). It is often based on a physical model of the loudspeaker, including the electrical, mechanical and acoustical properties. As an example, a linear model is described of a loudspeaker. The invention is not limited to this case, but can be used for any type of loudspeaker model.

The voltage equation for an electrodynamic loudspeaker is the following:

$$v(t) = R_e i(t) + L_e \frac{di}{dt} + \phi \dot{x}(t), \tag{1}$$

where Re and Le are the DC resistance and the inductance of the voice coil when the voice coil is mechanically blocked, $\phi$ is the force factor (otherwise known as the Bl-product) which is assumed to be constant, and the derivate of x(t) is the velocity of the diaphragm. The Laplace transform yields $$v(s)=Z_e(s)i(s)+\phi s x(s), \tag{2}$$

where Ze(s)=(Re+Le s) is the blocked electrical impedance of the voice coil. Estimation methods for Ze are available in the literature and are based on recordings of voice coil voltage and current.

The force factor, $\phi$, represents the ratio between the Lorentz force, which is exerted on the cone, and the input current, such that $$\phi i(s)=f(s), \tag{3}$$

which is referred to as the force equation. The mechanical impedance is defined as the ratio between force and velocity:

$$Z_m(s) = \frac{f(s)}{s x(s)}, \tag{4}$$

due to which the voltage equation can be rewritten as:

$$v(s) \overset{(2),(3),(4)}{=} Z_e(s)i(s) + \frac{\phi^2 i(s)}{Z_m(s)} \tag{5}$$

The voltage and force equations can be combined and the mechanical impedance can be derived:

$$Z_m(s) = \frac{\phi^2}{Z(s) - Z_e(s)}, \tag{6}$$

where the electrical impedance is denoted by Z(s)=v(s)/i(s). The combination of Eq. (4) and (3) yields:

$$\phi i(s)=Z_m(s)s x(s) \tag{7}$$

The frequency-dependent voltage-to-excursion transfer function can be obtained in the following manner:

$$h_{vx}(s) = \frac{x(s)}{v(s)} = \frac{x(s)}{i(s)} \cdot \frac{i(s)}{v(s)} \tag{8}$$

$$\overset{(7)}{=} \frac{\phi}{sZ_m(s)} \cdot \frac{1}{Z(s)} \tag{9}$$

By making assumptions regarding the mounting of the loudspeaker, a parametric model of the electrical impedance, Z(s), can be formulated. For instance, if the loudspeaker is mounted in a sealed enclosure, the system behaves as a single-degree-of-freedom mechanical oscillator. The parameters of the impedance model can then be determined by minimising a discrepancy measure between the measured electrical impedance, which can be obtained from measurements of the voice coil voltage and current, and the impedance predicted by the model, with respect to the model parameters. From the electrical impedance, Z(s), the voltage-to-excursion transfer function (Eq. (9)) can be determined.

It can be observed that the voltage-to-excursion transfer function (Eq. (9)), which yields the prediction of the excursion for a given input voltage signal, can be computed if the electrical impedance is determined from measurements of voltage and current signals, Z(s)=v(s)/i(s), and if the force factor $\phi$ is known. If the force factor is not known, the voltage-to-excursion transfer function is known apart from an unknown scaling factor, and the transfer function can be estimated from the voltage across and the current flowing into the loudspeaker voice coil.

The first step of this example of the invention is to compute a "normalised" loudspeaker diaphragm displacement model, i.e., a voltage-to-excursion transfer function that yields an expected normalised excursion for a given voltage input signal. The normalised voltage-to-excursion transfer function, $h_{vx,n}(s)$ is defined as the transfer function that is obtained by setting the unknown parameter (in this case $\phi$) to a fixed (arbitrary) value, e.g., to unity:

$$h_{vx,n}(s) = \frac{1}{sZ_m(s)Z(s)}. \tag{10}$$

By normalised in this context is meant a function that is accurate up to a scaling factor that is arbitrary (i.e. not known), but fixed.

The measurements needed to derive this normalised model are the voice coil voltage and the current, while a test sequence is played that allows for the estimation of the impedance function for a plurality of frequencies.

Non-Linearity Analysis

There exist several methods for determining the maximally allowable cone excursion, i.e., the excursion limit, $x_{max}$. The method defined in standard AES2-1984 (r2003) is based on a harmonic distortion measurement. $x_{max}$ is determined as the displacement for which "the "linearity" . . . deviates by 10% . . . . Linearity may be measured by percent distortion of the input current or by percent deviation of displacement versus input current."

It has been proposed in the article "Assessment of voice coil peak displacement Xmax". J. Audio Eng. Soc. 51 (5), 307-324, to measure both harmonic and modulation distortion in the near field sound pressure using a two-tone excitation signal, consisting of a bass tone to generate some diaphragm displacement and a voice tone at a higher frequency.

The excursion limit can be determined by reproducing a test signal at increasing volume levels on the loudspeaker and monitoring a distortion measure.

If the diaphragm displacement can be measured, e.g., using a laser displacement meter, $x_{max}$ can be measured as the displacement at the point where the distortion measure, which is computed based on the laser measurement, reaches a certain threshold. If the diaphragm displacement cannot be measured, the distortion measure needs to be measured on other signals (e.g., the voice coil current, sound pressure). This way, the input voltage signal that generates the maximally allowable displacement can be determined, and it will be referred to as $v_{max}(t)$.

This is a voltage time signal, corresponding to a normalised excursion time signal. The maximal value of this excursion time signal yields the normalised displacement limit (Eq. (12) below).

The second step of this example of the invention is to obtain this excursion limit. This can be obtained by known methods as outlined above, for example by performing a non-linearity analysis by reproducing a test signal at increasing volume levels and monitoring a distortion measure (such as the harmonic distortion of the current flowing into the voice coil).

As one example, the distortion measure can be implemented using the following exemplary procedure:

reproduce a sine wave at the resonance frequency of the loudspeaker, $f_{res}$, at amplitude level k, by sending a source (voltage) signal $v_k(t)$ to the loudspeaker;

compute the total harmonic distortion (THD) of the current signal:

$$THD = \frac{\sum_{n=2}^{L} \sqrt{P(nf_{res})}}{\sqrt{P(f_{res})}} \cdot 100 \tag{11}$$

where $P(n\ f_{res})$ is the power of the nth harmonic of $f_{res}$;

determine the amplitude (volume) level $k_{max}$ for which the THD reaches a certain threshold, such as 10%. This yields the input signal, $v_{max}(t)$, that generates the maximally allowable displacement.

This procedure does not require a measurement of the diaphragm displacement, since it only uses the current flowing into the voice coil. It yields a signal $v_{max}(t)$ which generates the maximally allowable displacement, $x_{max}$. Note that $x_{max}$ proper has not been measured and is not known.

Normalised Excursion Limit

The third step in this example of the invention is to determine the normalised excursion limit. This is simply the maximal excursion that is obtained from the normalised loudspeaker model when the signal vmax(t) is provided as input:

$$x_{max,n} = \max[|h_{vx,n}(t) * v_{max}(t)|], \tag{12}$$

where * denotes the convolution operator. In other words, $x_{max,n}$, is the displacement that is obtained from the normalised model when the loudspeaker is driven to its displacement limit. Thus, for an arbitrary input signal and without knowledge of the mechanical parameters of the loudspeaker, it can be predicted whether or not the loudspeaker is driven below, at, or beyond its displacement limit, assuming the loudspeaker model assumptions (e.g., regarding the enclosure and the linearity) are valid. This way, it can be computed whether a loudspeaker is driven towards its displacement limit without knowing the actual value of the displacement limit.

Control Signal for Loudspeaker Protection

A loudspeaker protection algorithm is usually controlled by a signal, c(t), that is a measure of the relation between the (predicted) diaphragm displacement and the displacement limit. An example of such a control signal is the ratio between predicted displacement and displacement limit:

$$c(t) = \frac{|h_{vx}(t) * v(t)|}{x_{max}}. \tag{13}$$

A basic loudspeaker protection algorithm should lower the expected diaphragm displacement, e.g., by attenuation of the input signal, if $c(t)<1$.

A similar control signal, $c_n(t)$, can be obtained using the invention on the basis of the normalised displacement and the normalised displacement limit. For an input voltage signal, v(t), the normalised excursion signal, $x_n(t)$ can be obtained as follows:

$$x_n(t) = h_{vx,n}(t) * v(t). \tag{14}$$

An example control signal using the invention is the ratio:

$$c_n(t) = \frac{|x_n(t)|}{x_{max,n}}. \tag{15}$$

This is equivalent to Eq. (13), since $x_n(t)$ and $x_{max,n}$ are versions of x(t) and $x_{max}$ that are scaled by a same (arbitrary) factor.

The loudspeaker protection algorithm should lower the expected diaphragm displacement, e.g., by attenuation of the input signal, if $c_n(t)<1$. It should be noted that any known loudspeaker protection algorithm can be used, and that it can be more complex than the example given here. The invention essentially provides a way to derive the control signal.

The control signal derived by the method of the invention is used in a loudspeaker drive system. It can for example be used in a system that includes a loudspeaker protection module. Traditional control signals require the knowledge of a mechanical parameter of the loudspeaker, whereas the proposed control signal does not. Thus, a loudspeaker protection system can be developed that does not require knowledge of the mechanical parameters of the loudspeaker. This broadens the applicability and generality of a loudspeaker protection system, since it allows the system to operate with arbitrary loudspeakers without knowledge of the mechanical parameters.

A procedure which determines the normalised loudspeaker model and the normalised displacement limit can be incorporated in a calibration procedure. The procedure can be performed at start-up of the device, or in the production line in the factory.

The system of the invention means that using only voltage and current measurements (or optionally an optical measurement of the displacement limit) can be used to derive a loudspeaker model which can represent the following loudspeaker parameters:

The equations given above represent only one way to model the behaviour a loudspeaker. Different analytical approaches are possible which make different assumptions and therefore provide different functions. However, alternative detailed analytical functions are within the scope of the invention as claimed.

The analysis above shows the calculation of a normalised loudspeaker model. However, this can be considered only to be an intermediate computational product and it serves to explain the physical model. In practice, an algorithm will process the measured current and voltage values and the non-linearity analysis and will have no need to explicitly calculate intermediate values or functions such as the normalised loudspeaker model. Similarly, the frequency-dependent impedance function does not need to be presented as an output from the system, and it is also an intermediate computational resource. The output of the system can for example simply comprise the control signal expressed in equation (15).

FIG. 1 shows a loudspeaker system of the invention. A digital-to-analog converter 20 prepares the analog loudspeaker signal, which is amplified by amplifier 22. A series resistor 24 is used for current sensing, in the path of the voice coil of the loudspeaker 26.

The voltages on each end of the resistor 24 are monitored by a processor 30, which implements the algorithm of the invention, and thereby derives the frequency-dependent input-voltage-to-excursion transfer function. The two voltages across the resistor enable both the current and the voltage across the coil to be measured (as one side of the voice coil is grounded).

The processor 30 also implements the non-linearity analysis explained above.

The derived functions are used to control the audio processing in the main processor 28 which drives the converter 20, in order to implement loudspeaker protection and/or acoustic signal processing (such as flattening, or frequency selective filtering).

The measurements used to derive the normalised loudspeaker model are the voltage and current values. These can be processed to derive impedance values Z which appear in the equations above. However, these are again intermediate processing values, which do not in themselves need to be calculated.

The measurements are used to derive a set of discrete (digital) measurements at different frequencies, within the audible frequency band. The desired frequency range depends on the application. For example, for loudspeaker excursion protection, it is sufficient to examine frequencies below for example 4000 Hz, while speaker linearisation may require the full audio bandwidth (up to 20 kHz).

Similarly, the number of frequencies sampled within the band of interest will depend on the application. The amount of smoothing of the impedance function, or the amount of averaging of the voltage and current information, depends on the signal-to-noise ratio of the voltage and current measurements.

The method of this example of the invention can be implemented as a software algorithm, and as such the invention also provides a computer program comprising computer program code means adapted to perform the method, and the computer program can be embodied on a computer readable medium such as a memory. The program is run by and stored in the processor block 28.

Figure 2:
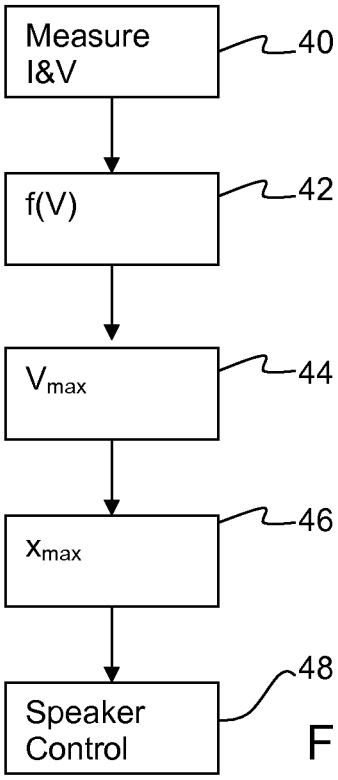
FIG. 2 shows a first example of loudspeaker control method of the invention.

FIG. 2 shows the steps of the method.

In step 40 the voltage and current is measured at a set of frequencies.

The arbitrarily scaled frequency-dependent input-voltage-to-excursion transfer function is determined in step 42.

The non-linearity analysis is carried out in step 44 to determine the input level at which the excursion reaches a maximum value.

The maximal displacement limit for the determined level based on the same arbitrary scaling is derived in step 46.

The audio processing is controlled in step 48 for the loudspeaker thereby to implement loudspeaker protection and/or acoustic signal processing.

The approach explained in detail above can be modified without departing from the underlying concepts.

Figure 3:
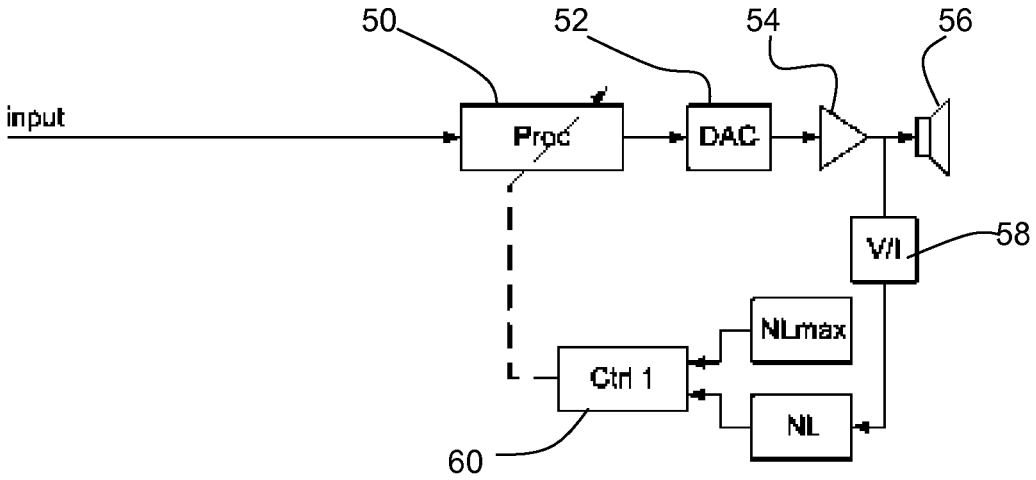
FIG. 3 shows a second example of loudspeaker control system of the invention.

A basic scheme of a second example of system of the invention is shown in FIG. 3.

The input is processed by processor 50 and the output is sent to a digital-to-analog converter 52. This signal is amplified by an amplifier 54 and sent to the loudspeaker 56. As in the example above, the loudspeaker voice coil voltage and current are measured by sensor 58 and used for computing a non-linearity measure ("NL"). This non-linearity measure is the control input for a first control module 60 that controls the processing module 50 as a function of the non-linearity measure ("NL") and a user-defined threshold ("NLmax").

The processing module 50 can be a simple gain or a dynamic range compression (DRC) algorithm, possibly in a multi-band approach (such that separate frequency regions are processed separately).

It can also contain a filtering operation, such as a high-pass filter, a shelving filter or an anti-resonant filter to transform the expected linear transfer function from the input signal to the acoustical output of the loudspeaker to a desired transfer function.

The measure of non-linearity is based on the voice coil voltage and current.

This example shows a generic measurement of non-linearity instead of the specific example of maximum excursion of the previous example. It also shows the use of the non-linearity parameter as the control input for the processing of the audio signal. This approach implements a feedback control loop which avoids the need for the input-voltage-to-excursion transfer function.

There are several possibilities to compute the measure of non-linearity based on the electrical impedance of the loudspeaker:

$$v[k]=i[k]*z[k] \tag{16}$$

where * denotes the convolution operator, and z[k] is the impulse response corresponding to the electrical impedance function of the loudspeaker (the linear transfer function from current to voltage).

A first possibility uses a fixed electrical impedance, that is determined in an initial estimation phase.

The impedance function can be determined by playing a noise sequence on the loudspeaker at a low amplitude, such that the diaphragm displacement is very small, and computing the transfer function from current to voltage. Estimation methods are available in the literature.

The impulse response corresponding to this transfer function is referred to as $z_0[k]$. The measure of non-linearity is derived from the discrepancy between the measured voltage $\tilde{v}[k]$, and that expected from the measured current $\tilde{i}[k]$, given the fixed electrical impedance:

$$e_0[k]=\tilde{v}[k]-\tilde{i}[k]*z_0[k] \tag{17}$$

An example non-linearity measure is the ratio of the (smoothed) signal powers of the measured voltage and $e_0[k]$.

A second possibility uses an adaptive electrical impedance, that is estimated in an on-line manner. Indeed, the impedance can be estimated using an adaptive filter that minimises the following error signal in terms of the impulse response $z_1[k]$:

$$e_1[k]=\tilde{v}[k]-\tilde{i}[k]*z_1[k] \tag{18}$$

This possibility adapts to changes in the impedance function due to, e.g., loudspeaker aging, and takes into account differences across samples. Furthermore, it does not require an initial estimation stage.

Many methods exist for the minimisation required to determine $z_1[k]$, which are readily available in the literature. An example non-linearity measure is the ratio of the (smoothed) signal powers of the measured voltage and $e_1[k]$.

The user-defined threshold value for the non-linearity ("NLmax") that is used by the control module 60 can be set to a 'safe' level, due to which the loudspeaker is mechanically protected and non-linear signal distortions are allowed. This yields a loudspeaker protection method.

Conversely, the threshold value can be set to a 'strict' level, due to which the loudspeaker is only operated in its linear regime (no non-linear loudspeaker distortions are allowed). This yields a method that is related to the pre-compensation application, but rather than pre-processing the input such that the signal distortion is minimised, the input is pre-processed such that no signal distortions are physically generated by the loudspeaker.

Thus, the control scheme implemented in the first control module 60 is aimed at keeping the non-linearity measure ("NL") below a user-defined threshold value ("NLmax"). This is achieved by modifying the parameters in the processing module 50 in such a way that the expected non-linearity decreases when the threshold value is exceeded.

Optionally, it can maximise the non-linearity measure (without exceeding the threshold value), such that the acoustical output is maximised. This is achieved by modifying the parameters in the processing module 50 in such a way that the expected non-linearity increases when the threshold value is not exceeded.

The processes for limiting and maximising the non-linearity measure may have different adaptation speeds.

The non-linearity of the loudspeaker is tightly linked to the diaphragm displacement. Therefore, to decrease the expected value of the non-linearity measure, the parameters of the processing module 50 can be adjusted in such a way that the expected loudspeaker diaphragm displacement is decreased, e.g. by adding an attenuation of the complete signal or of the lower frequency region, or by changing the DRC parameters, or by increasing the cut-off frequency of the high-pass filter.

Figure 4:
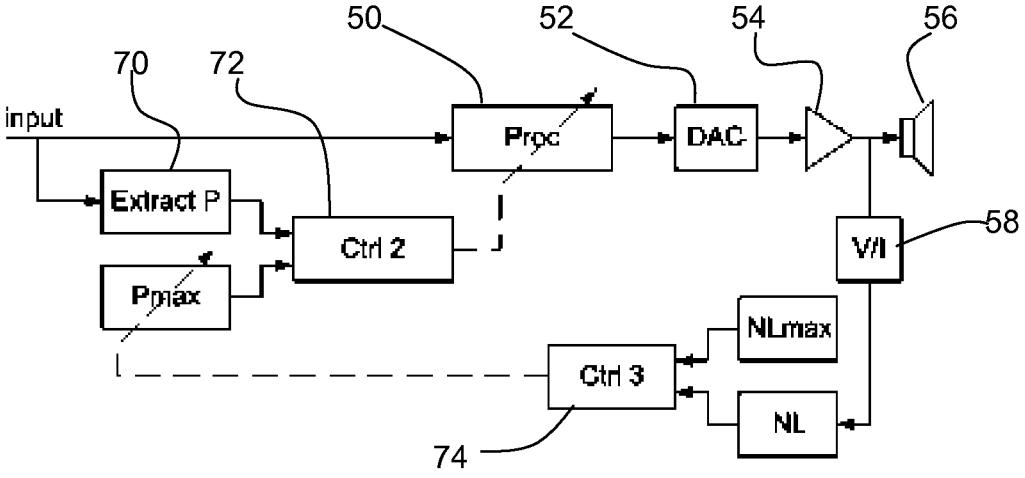
FIG. 4 shows a third example of loudspeaker control system of the invention.

A third example of the invention is shown in FIG. 4.

In this example, the controlled parameter of the input signal does not have to be identical to the parameter used as a measure of non-linearity.

The input is again processed by a processing module 50, sent to the DAC 52, amplified and sent to the loudspeaker 56. The voice coil voltage and current are again measured by sensor 58, and a non-linearity measure is computed ("NL").

The input signal is sent to a module 70 for extracting a parameter "P". The signal provided to the processing module 50 is modified by a second control module 72 as a function of the extracted parameter P and its limit value ("Pmax").

This approach can use the arbitrarily scaled frequency-dependent input-voltage-to-excursion function as explained above for the extraction of the parameter P.

A third control module 74 adapts the limit value for the extracted parameter ("Pmax") as a function of the non-linearity measure ("NL") and its user-defined threshold ("NLmax"). Thus, the non-linearity measure is effectively converted into a parameter value of the input signal. The limit value ("Pmax") can be adjusted over time, for example reducing the value of Pmax if the user-defined threshold NLmax is exceeded.

The parameter from the input signal is not the same as the non-linearity measure, but it is related to the generation of non-linearities in the loudspeaker, such as the peak normalised diaphragm displacement (as used in the first example above). It can be derived from a linear loudspeaker model, in which case it can be obtained by a filtering operation (convolution with the voltage-to-displacement transfer function), followed by a peak extraction.

It can also be derived from a non-linear loudspeaker model, followed by a peak extraction.

This parameter is compared to the limit value "Pmax". Since this limit value is adaptively adjusted by the control unit 74 on the basis of the non-linearity measure "NL", which is a direct measurement of the non-linearity, the extracted parameter can be arbitrarily scaled as explained above, as the limit value for this parameter will simply scale by the same factor.

This is important in the case where the parameter corresponds to the diaphragm displacement, since it can be predicted only up to an unknown scaling factor if no further knowledge is available from the loudspeaker.

In this example, the second control module 72 keeps the extracted parameter below a threshold value ("Pmax"). The processing in the processing module 50 is adapted in such a way that the expected parameter value decreases when it exceeds the limit value ("Pmax").

Again, the processing module can maximise the extracted parameter (without exceeding the limit value), such that the acoustical output is maximised.

In all examples above, the invention allows for a loudspeaker protection scheme without knowledge of a physical parameter of the loudspeaker (such as the mechanical mass and force factor). This is in contrast to current loudspeaker protection algorithms, which require the knowledge of a physical loudspeaker parameter (because the limit value is specified as a physical distance, due to which the displacement needs to be correctly scaled.

Various modifications will be apparent to those skilled in the art.

The invention claimed is:

1. A method of controlling a loudspeaker output, comprising:

measuring a voltage loudspeaker signal and a current loudspeaker signal;

performing a non-linearity analysis to determine results based on respective values of the voltage and the current measurements and based on an excursion limit, wherein the excursion limit is a function of harmonic distortion associated with the current measurements; and using the results of the non-linearity analysis to control audio processing for the loudspeaker by implementing at least one of loudspeaker protection and acoustic signal processing wherein the controlling of audio processing includes altering a parameter that has been found to cause a non-linearity through the non-linearity analysis.

2. A method as claimed in claim 1, comprising generating, based upon the measured voltage and current, a frequency-dependent voltage-to-excursion transfer function for the loudspeaker, wherein the non-linearity analysis includes executing the frequency-dependent voltage-to-excursion transfer function using the respective values of the voltage and current measurements as inputs.

3. A method as claimed in claim 1, wherein the voltage and current measurements and the non-linearity analysis are concurrently measured during part of a calibration process, and the steps of performing the non-linearity analysis and using the results of the non-linearity analysis include providing a control signal based on a normalized model of the loudspeaker corresponding to a signal for which a predefined displacement limit for a diaphragm of the loudspeaker is reached.

4. A method as claimed in claim 1, wherein the voltage and current signals are measured for a plurality of measurement frequencies which characterize a frequency-dependent impedance function of the loudspeaker, further including utilizing the voltage and current measurements to derive, using an arbitrary scaling, the frequency-dependent-voltage-to-excursion transfer function which is also used to control the audio processing; and wherein the performing the non-linearity analysis comprises:

determining an input level at which a cone excursion of the loudspeaker reaches a maximum value, which is associated with the excursion limit; and determining a maximal displacement limit for the determined level based on the same arbitrary scaling, and wherein the result of the non-linearity analysis comprise the maximal displacement limit.

5. A method as claimed in claim 4, wherein the voltage and current measurements characterize a frequency-dependent impedance function that is determined independently from values depicting mechanical properties of the loudspeaker.

6. A method as claimed in claim 4, wherein the voltage and current measurements characterize a frequency dependent impedance function which does not take into account one of a force factor of the loudspeaker and a moving mass of the loudspeaker.

7. A method as claimed in claim 1, wherein controlling the audio processing comprises deriving an attenuation value by which an input signal should be attenuated to provide loudspeaker protection.

8. A method as claimed in claim 1, wherein controlling the audio processing comprises processing the audio input to provide a limit to a parameter monitored in the non-linearity analysis.

9. A method as claimed in claim 1, wherein controlling the audio processing comprises processing the audio input to provide a limit to a parameter, which parameter is one of a direct cause and an indirect cause of the non-linearity as monitored in the non-linearity analysis and the limit of the parameter is adapted based on the results of the non-linearity analysis.

10. An article of manufacture comprising a non-transitory storage medium having computer program code stored thereupon and configured and arranged to perform all the steps of claim 1 when said computer program code is executed by a computer.

11. A method as claimed in claim 3, further including estimating the voltage-to-excursion transfer function based on the voltage and current measurements during the calibration process, and wherein the step of using the results of the non-linearity analysis to control audio processing for the loudspeaker includes using the voltage-to-excursion transfer function to control the audio processing.

12. A method as claimed in claim 1, wherein performing the non-linearity analysis includes determining a signal that causes a diaphragm of the loudspeaker to reach a predefined allowable displacement limit, and computing a normalized diaphragm excursion value from a normalized model of the loudspeaker that is based on the signal.

13. A method as claimed in claim 12, wherein using the results of the non-linearity analysis includes providing a control signal for an arbitrary voltage signal based on the normalized model and the normalized diaphragm excursion value, and using the control signal to control the audio processing.

14. A method as claimed in claim 1, including generating the frequency-dependent voltage-to-excursion transfer function by measuring the voltage and current signals for a signal of increasing amplitude, and determining the results of the non-linearity analysis using respective values of the voltage and current measurements for the signal of increasing amplitude.

15. A loudspeaker control system, comprising:

a loudspeaker;

a sensor circuit configured and arranged to measure a voltage and a current of an input signal coupled to the loudspeaker; and a processor circuit configured and arranged with the sensor circuit to:

control the sensor to measure a voltage signal and current signal;

generate, based upon the measured voltage and current, a frequency-dependent input-voltage-to-excursion transfer function for the loudspeaker; and perform a non-linearity analysis to determine results using the respective voltage and current measurements as respective inputs to the frequency-dependent input-voltage-to-excursion transfer function, and to determine an excursion limit using harmonic distortion associated with the current measurements; and use the results of the non-linearity analysis to control audio processing for the loudspeaker by implementing at least one of loudspeaker protection and acoustic signal processing, wherein the controlling of audio processing includes altering a parameter that has been found to cause a non-linearity through the non-linearity analysis.

16. A system as claimed in claim 15, wherein the processor circuit is adapted to:

control the sensor to concurrently measure the voltage signal and the current signal for a plurality of measurement frequencies which characterize a frequency-dependent impedance function of the loudspeaker, and use the voltage and current measurements to derive, using an arbitrary scaling, the frequency dependent input-voltage-to-excursion transfer function, which function is also used in the control of the audio processing, and wherein performing the non-linearity analysis comprises determining an input level at which a cone excursion of the loudspeaker reaches a maximum value and determining a maximal displacement limit for the determined level based on the arbitrary scaling.

17. A system as claimed in claim 15, wherein the voltage and current measurements characterize a frequency-dependent impedance function that is determined independently from values depicting mechanical properties of the loudspeaker.

18. A system as claimed in claim 15, wherein controlling the audio processing comprises deriving an attenuation value by which an input signal should be attenuated to provide loudspeaker protection.

19. A system as claimed in claim 15, wherein the processor circuit is configured and arranged to perform the non-linearity analysis by:

determining a point where a diaphragm of the loudspeaker reaches a predefined allowable displacement limit, and computing a normalized diaphragm excursion value from a normalized model of the loudspeaker based on a signal for which the displacement limit is reached.

20. A system as claimed in claim 19, wherein the processor circuit is configured and arranged to estimate a voltage-to-excursion transfer function based on the voltage and current measurements, compute a control signal for an arbitrary voltage signal based on the normalized model, the normalized diaphragm excursion value and the voltage-to-excursion transfer function, and control the audio processing for the loudspeaker using the control signal.

* * * * *